US009982359B2

(12) United States Patent
Sato et al.

(10) Patent No.: US 9,982,359 B2
(45) Date of Patent: May 29, 2018

(54) SURFACE TREATMENT METHOD AND SURFACE TREATMENT DEVICE

(71) Applicant: TOYOTA JIDOSHA KABUSHIKI KAISHA, Toyota-shi, Aichi-ken (JP)

(72) Inventors: Yuki Sato, Nisshin (JP); Motoki Hiraoka, Toyota (JP); Hiroshi Yanagimoto, Miyoshi (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 90 days.

(21) Appl. No.: 14/955,791

(22) Filed: Dec. 1, 2015

(65) Prior Publication Data

US 2016/0160378 A1 Jun. 9, 2016

(30) Foreign Application Priority Data

Dec. 3, 2014 (JP) ..... 2014-245035

(51) Int. Cl.

| | |
|---|---|
| ***C25F 3/14*** | (2006.01) |
| ***C25D 5/02*** | (2006.01) |
| ***C25D 17/00*** | (2006.01) |
| ***C25F 7/00*** | (2006.01) |

(52) U.S. Cl.

CPC ..... *C25F 3/14* (2013.01); *C25D 5/022* (2013.01); *C25D 17/002* (2013.01); *C25F 7/00* (2013.01)

(58) Field of Classification Search

CPC ... C25F 3/14; C25F 7/00; C25D 5/022; C25D 17/002

See application file for complete search history.

(56) References Cited

U.S. PATENT DOCUMENTS

| | | | | |
|---|---|---|---|---|
| 4,045,312 | A * | 8/1977 | Satoshi | C25F 3/02 205/666 |
| 7,998,323 | B1 * | 8/2011 | Chandra | C25D 5/22 204/224 M |
| 2004/0060174 | A1 | 4/2004 | Imafuji et al. | |
| 2004/0154828 | A1 * | 8/2004 | Moller | C25D 5/02 174/256 |
| 2006/0260952 | A1 * | 11/2006 | Mazur | B23H 5/08 205/668 |

(Continued)

FOREIGN PATENT DOCUMENTS

| | | |
|---|---|---|
| CN | 1491076 A | 4/2004 |
| JP | 49-037011 B | 10/1974 |

(Continued)

OTHER PUBLICATIONS

Hiraoka et al. (JP 2014114474 A, machine translation).*

*Primary Examiner* — Susan D Leong
*Assistant Examiner* — Joshua L Allen
(74) *Attorney, Agent, or Firm* — Sughrue Mion, PLLC

(57) ABSTRACT

A surface treatment method includes: roughening a surface region of a substrate corresponding to a through hole provided to a masking plate by supplying a solvent to a solid electrolyte film from a second surface of a masking plate through the through hole, in a state where: a first surface of the solid electrolyte film is arranged directly on the surface of the substrate; and a first surface of the masking plate is arranged directly on a second surface of the solid electrolyte film, wherein the supplied solvent penetrates the solid electrolyte film, and dissolves the surface of the substrate.

5 Claims, 6 Drawing Sheets

(56) References Cited

U.S. PATENT DOCUMENTS

| | | | | |
|---|---|---|---|---|
| 2010/0021776 | A1* | 1/2010 | Dougherty | C25D 9/08<br>429/406 |
| 2013/0048504 | A1* | 2/2013 | Medina | C25F 1/02<br>205/219 |
| 2015/0014178 | A1* | 1/2015 | Hiraoka | C25D 5/08<br>205/261 |

FOREIGN PATENT DOCUMENTS

| | | | | | |
|---|---|---|---|---|---|
| JP | 60-063400 | A | | 4/1985 | |
| JP | 02-182893 | A | | 7/1990 | |
| JP | 2001-073174 | A | | 3/2001 | |
| JP | 2006161090 | A | | 6/2006 | |
| JP | 2008045218 | A | | 2/2008 | |
| JP | 2014-114474 | A | | 6/2014 | |
| JP | 2014114474 | A | * | 6/2014 | |
| WO | 2013125643 | A1 | | 8/2013 | |
| WO | WO 2013125643 | A1 | * | 8/2013 | C25D 5/08 |

* cited by examiner

SURFACE TREATMENT METHOD AND SURFACE TREATMENT DEVICE

INCORPORATION BY REFERENCE

The disclosure of Japanese Patent Application No. 2014-245035 filed on Dec. 3, 2014 including the specification, drawings and abstract is incorporated herein by reference in its entirety.

BACKGROUND OF THE INVENTION

1. Field of the Invention

The invention relates to a surface treatment method and a surface treatment device for partially roughening a surface of a substrate.

2. Description of Related Art

Conventionally, when a metallic film is formed on a surface of a substrate and so on, it is general that pretreatment is carried out on the surface of the substrate in order to improve adherence of the metallic film. For example, in Japanese Patent Application Publication No. 2001-073174 (JP 2001-073174 A), after masking a surface of a substrate except a film forming region, alkaline degreasing is carried out in the film forming region. Thereafter, a high pressure water flow is sprayed on the surface on which alkaline degreasing was carried out, thereby removing an oxide film (a passive film) of the substrate. With the technology described in JP 2001-073174 A, the oxide film formed on the surface of the film forming region is physically removed by a high pressure water flow, thus making it possible to form a metallic film with high adherence in the film forming region.

As another technology, Japanese Patent Application Publication No. 2014-114474 (JP 2014-114474 A) proposes a surface treatment method, in which a solid electrolyte film containing a solvent is arranged between a substrate serving as a positive electrode, and a negative electrode, the solid electrolyte film is brought into contact with a metal surface of the substrate, and voltage is applied between the substrate and the negative electrode. Thus, metal in a metal surface of the substrate is ionized into metal ion, thereby etching the metal surface of the substrate.

However, when the surface treatment technologies in JP 2001-073174A, JP 2014-114474 A and so on are used to partially roughen a substrate, it is necessary to mask every substrate except a surface region to be treated. Moreover, after the roughening, it is necessary to remove a masking material used to mask a surface of a substrate. Further, with the surface treatment technology described in JP 2001-073174 A, a high pressure water flow is sprayed on a substrate, and that could make a masking material peel off when trying to roughen a surface of a substrate further.

SUMMARY OF THE INVENTION

The invention has been made in light of this situation, and provides a surface treatment method and a surface treatment device, which makes it possible to partially roughen a desired surface region of a surface of a substrate easily by using a solvent that dissolves the surface of the substrate.

A surface treatment method according to a first aspect of the invention includes roughening a surface region of a substrate corresponding to a through hole provided to a masking plate by supplying a solvent to a solid electrolyte film from a second surface of the masking plate through the through hole, in a state where a first surface of the solid electrolyte film is arranged directly on the surface of the substrate, and a first surface of the masking plate is arranged directly on a second surface of the solid electrolyte film. The supplied solvent penetrates the solid electrolyte film, and dissolves the surface of the substrate.

With the surface treatment method according to the first aspect of the invention, the solvent penetrates a part of the solid electrolyte film corresponding to the shape of the through hole when the solvent is supplied to the solid electrolyte film through the through hole from the surface of the masking plate on the other side. The part of the solid electrolyte film where the solvent penetrates is in contact with the surface of the substrate. Therefore, in the surface of the substrate, the material of the surface region corresponding to the shape of the through hole of the masking plate reacts with the solvent, and is thus dissolved by the solvent (to be specific, hydrogen ion, hydroxide ion, a complexing agent, or other oxidizing agent). Thus, the surface region of the substrate is roughened easily.

In the surface treatment method according to the first aspect of the invention, it is possible to roughen a desired surface region in the surface of the substrate by using the solvent instead of directly masking the substrate. Since the surface region of the substrate is roughened through the solid electrolyte film, it is possible to prevent too much solvent from adhering to the surface of the substrate.

The "substrate" described in the aspects of the invention may be any substrate as long as the substrate has a surface that can be roughened as the solvent dissolves (a material of) the surface to be partially roughened. The substrate may also be a substrate that itself is dissolved or a substrate having a surface layer that is dissolved by the solvent.

In the first aspect, the surface of the substrate may be made from metal, and the roughening may include applying voltage between the substrate serving as a positive electrode and a conductive member serving as a negative electrode in a state where the conductive member is provided on the second surface of the masking plate.

In the above aspect, the solvent may be supplied from a liquid accommodating chamber of a liquid supplying part, and the conductive member may be arranged on the second surface of the masking plate through the liquid accommodating chamber.

According to the above aspect, voltage is applied between the conductive member serving as the negative electrode and the substrate serving as the positive electrode in the state where the solvent is supplied to the solid electrolyte film through the through hole from the surface of the masking plate on the other side. In the surface (the metal surface) of the substrate, metal of the surface region corresponding to the shape of the through hole of the masking plate is ionized by electrolysis. Thus, the foregoing oxidation-reduction reaction is promoted, thus making it possible to partially roughen the surface region, which corresponds to the shape of the through hole, in the surface of the substrate swiftly and easily. In particular, by adjusting the time of application, temperature of the substrate, temperature of the solvent, applied voltage, and so on when voltage is applied between the substrate and the conductive member, it is possible to roughen only the surface region of the substrate to have desired surface roughness.

As a second aspect of the invention, a method for forming a metallic film is disclosed together with the foregoing surface treatment method. A method for forming a metallic film according to the second aspect of the invention includes: roughening a surface region of the substrate by the surface treatment method according to the first aspect of the invention; after the roughening, allowing metal ion to penetrate the solid electrolyte film by supplying a metallic solution containing the metal ion of the metallic film to the solid electrolyte film through the through hole; and forming a metallic film on the surface region by depositing the metal ion of the metallic solution on the roughened surface region by applying voltage between the substrate serving as a negative electrode and the conductive member serving as a positive electrode.

According to the second aspect, after the surface treatment, the solvent is changed to the metallic solution, the polarity is inverted between the conductive member and the substrate, and voltage is applied between the conductive member and the substrate. That is all it takes to form the metallic film on the surface region of the substrate easily. Since the metallic film is formed on the roughened surface region of the substrate, it is possible to partially form the metallic film with high adherence on the substrate.

In this specification, a surface treatment device, which is able to suitably carry out surface treatment for the substrate, is also disclosed as a third aspect of the invention. A surface treatment device according to the third aspect of the invention includes: a solid electrolyte film that has a first surface and a second surface, and allows the solvent to penetrate the solid electrolyte film, the first surface of the solid electrolyte film being to be brought into direct contact with the surface of the substrate; a masking plate having a through hole corresponding to a surface region of the substrate, a first surface, and a second surface, the first surface of the masking plate being arranged directly on the second surface of the solid electrolyte film, the surface region being to be roughened; and a liquid supplying part that is configured to supply the solvent to the first surface of the solid electrolyte film from the second surface of the masking plate through the through hole.

According to the third aspect, it is possible to arrange the solid electrolyte film on the substrate so that the first surface of the solid electrolyte film comes into contact with the surface of the substrate. It is also possible to arrange the masking plate so that the masking plate comes into contact with the second surface of the solid electrolyte film. By supplying the solvent to the solid electrolyte film through the through hole of the masking plate in this state, the solvent penetrates the solid electrolyte film, and the penetrated solvent dissolves (the material of) the surface of the substrate. Thus, it is possible to partially roughen the surface of the substrate easily without directly masking the substrate. Further, since the surface region of the substrate is roughened by the solvent through the solid electrolyte film, it is possible to prevent too much solvent from adhering to the surface of the substrate. Thus, it is possible to partially roughen the surface of the substrate more suitably.

In the third aspect, the surface treatment device may be configured to partially roughen a metallic surface of the substrate. The surface treatment device may include: a conductive member provided on the second surface of the masking plate; and a power supply configured to apply voltage between the substrate serving as a positive electrode and the conductive member serving as a negative electrode.

In the above aspect, the liquid supplying part may include a liquid accommodating chamber in which the solvent is accommodated, and the conductive member may be arranged on the second surface of the masking plate through the liquid accommodating chamber.

According to the above aspect, the power supply is able to apply voltage between the negative electrode, which is the conductive member, and the positive electrode, which is the substrate, in the state where the solvent is supplied to the solid electrolyte film through the through hole from the surface of the masking plate on the other side. Thus, in the surface (the metal surface) of the substrate, metal of the surface region corresponding to the shape of the through hole of the masking plate is ionized by electrolysis. In this way, it is possible to partially roughen the surface region, which corresponds to the shape of the through hole, in the surface of the substrate by using the solvent more swiftly and easily. In particular, by adjusting time for applying voltage between the substrate and the conductive member, and so on, it is possible to roughen only the surface region of the substrate to have desired surface roughness.

Further, the solvent is changed to the metallic solution containing metal ion of the metallic film, and polarity of the power supply is inverted. Thus, it is possible to deposit the metal ion of the metallic solution on the roughened surface region, and form the metallic film on the surface region.

According to the aspects of the invention, it is possible to partially roughen the desired surface region in the surface of the substrate easily, by using the solvent that dissolves the surface of the substrate.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

A surface treatment device, which is able to suitably carry out a surface treatment method according to three embodiments of the invention, is explained below with reference to FIG. 1 to FIG. 5.

Figure 1:
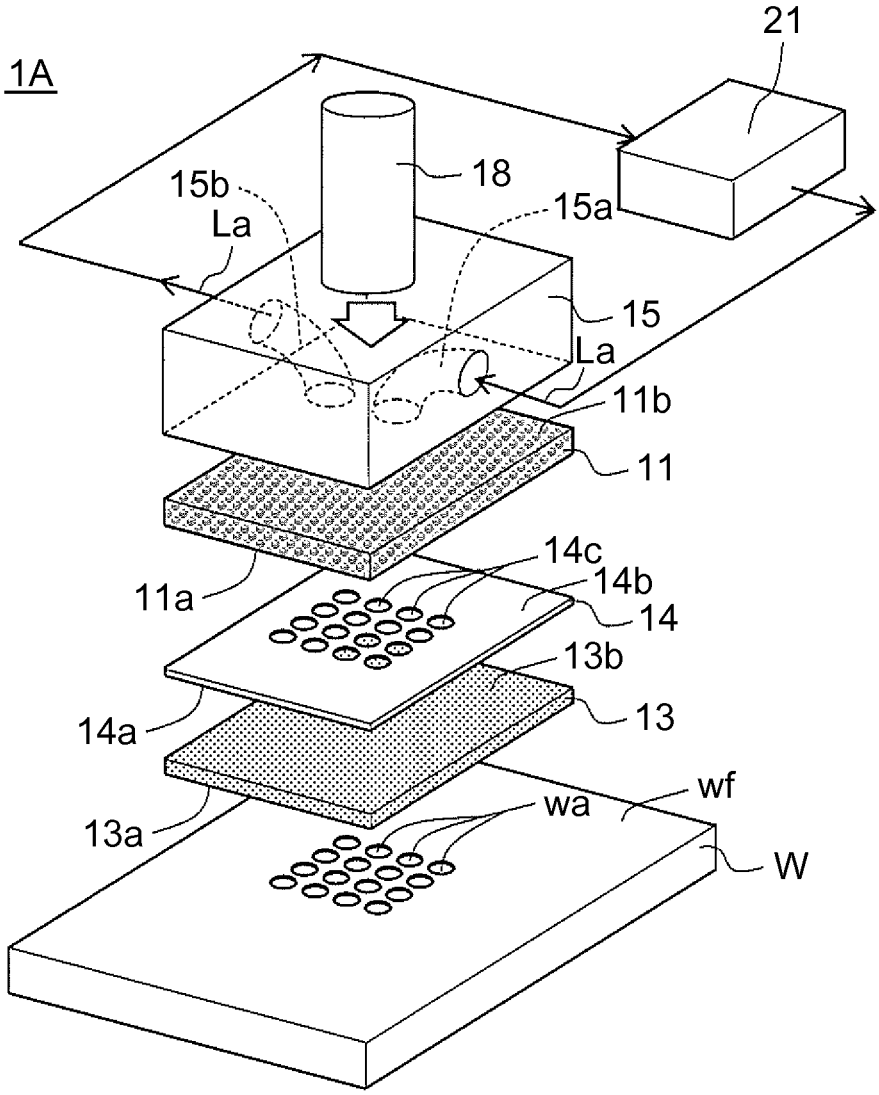
FIG. 1 is a schematic exploded perspective view of a surface treatment device according to the first embodiment of the invention.

The first embodiment of the invention is explained below. FIG. 1 is a schematic exploded perspective view of a surface treatment device 1A according to the first embodiment of the invention. As shown in FIG. 1, the surface treatment device 1A according to this embodiment is a device that roughens a part (a surface region wa) of a surface wf of a substrate W by using a solvent La that dissolves a material of the surface wf of the substrate W.

In example cases where the surface wf of the substrate W is made from metal, the substrate W is a substrate made from a metal material such as an aluminum-based material (aluminum or an alloy of aluminum), a copper-based material (copper or an alloy of copper), a zinc-based material (zinc or an alloy of zinc), and a tin-based material (tin or an alloy of tin), or a non-conductive substrate such as a resin substrate and a silicon substrate, on which a surface layer made from the above-mentioned metal is formed. Metal in the surface wf of the substrate W is made from a metal material that can be dissolved by a solvent of acid, alkali, complexing agent and so on. For example, when the above-mentioned metal is selected as metal in the surface wf of the substrate W, a solvent La is not particularly limited as long as the solvent La dissolves the selected metal. For example, a potassium hydroxide aqueous solution, aqueous solution of ferric chloride, an aqueous solution of nitric acid, an aqueous solution of sulfuric acid, and so on may be used as the solvent La.

The surface treatment device 1A includes a solid electrolyte film 13, a masking plate 14, a porous body 11 having open pores, and a liquid supplying part 15, and further includes a solvent supplying device 21 and a pressure device 18 as accessory devices.

The solid electrolyte film 13 is in contact with the surface wf of the substrate W and is made from a material that allows the solvent La to penetrate the solid electrolyte film 13, that is a material that allows hydrogen ion, hydroxide ion, or complex, which dissolves the surface wf, to penetrate the solid electrolyte film 13. The solid electrolyte film 13 is not particularly limited as long as the solid electrolyte film 13 allows the solvent La to penetrate inside the solid electrolyte film 13 when the solid electrolyte film 13 is brought into contact with the solvent La.

For example, when the solvent La is an acid solution where a component of the solvent La required for dissolution is cationic, a material for the solid electrolyte film may be a fluorine-based resin such as Nafion (registered trademark) manufactured by E. I. du Pont de Nemours and Company, a hydrocarbon-based resin, a polyamic acid resin, and a resin having a positive ion exchange function for conducting positive ion, such as SELEMION (registered trademark) (CMV, CMD, CMF series) manufactured by Asahi Glass Co., Ltd.

When the solvent La is an alkaline solution, or a component required for dissolution is anionic, it is possible to use a resin having a negative ion exchange function, such as NEOSEPTA (registered trademark) (AMX, AHA, ACS) manufactured by ASTOM Corporation, and SELEMION (AMV, AMT, AHO series) manufactured by Asahi Glass Co., Ltd.

In this embodiment, a surface made from metal is described as an example of the surface wf of the substrate W. However, in the case of the first embodiment, the surface wf of the substrate W may be made from a polymeric resin or a non-conductive inorganic material. For example, in a case where the surface wf of the substrate W is made from a polyurethane resin, an ABS resin, an epoxy resin and so on, the solvent may be a hydrochloric acid aqueous solution, a chromic acid aqueous solution, a hydrofluoric acid aqueous solution, and so on.

When the surface wf of the substrate W is made from silicon nitride (a non-conductive inorganic material), the solvent may be a phosphoric acid aqueous solution. When the surface wf of the substrate W is made from alumina (a non-conductive inorganic material), the solvent may be a sodium hydroxide aqueous solution. When the surface wf of the substrate W is made from silicon oxide (a non-conductive inorganic material), the solution may be a hydrofluoric acid aqueous solution.

When a surface that comes into contact with the surface wf of the substrate W is a first surface 13*a* of the solid electrolyte film 13, the masking plate 14 is fixed in a state of being in contact with a second surface 13*b* of the solid electrolyte film 13. A plurality of through holes 14*c* are formed in the masking plate 14 corresponding to surface regions wa to be roughened in the surface wf of the substrate W. Here, it is preferred that the masking plate 14 is made from a material that is insoluble in the foregoing solvent La, and may be made from either metal or resin.

When a surface in contact with the solid electrolyte film 13 is a first surface 14*a* of the masking plate 14, the porous body 11 is fixed to and in contact with a second surface 14*b* of the masking plate 14. The circumference of the porous body 11 is covered by a sealing material (not shown) so that the solvent La, which penetrates inside the porous body 11, flows into each of the through holes 14*c* of the masking plate 14 and does not leak out from the circumference of the porous body 11.

Further, in this embodiment, the porous body 11 is not limited as long as the porous body 11 (1) has corrosion resistance to the solvent La, (2) is able to allow the solvent La to penetrate the porous body 11, and (3) is able to press the solid electrolyte film 13 against the surface of the substrate W through the masking plate 14 by using the pressure device 18. Therefore, although the porous body 11 may be made from metal as shown in the second embodiment, the porous body 11 may also be made from a resin in this embodiment because the porous body 11 is not energized.

By providing the above-mentioned porous body 11, it is possible to stably carry out surface treatment for the substrate W by allowing the solvent La to pass through inside the solid electrolyte film 13 while the later-described pressure device 18 is pressing the solid electrolyte film 13 uniformly against the surface wf of the substrate W. The porous body 11 may be omitted as long as the solid electrolyte film 13 is pressed uniformly against the surface wf of the substrate W.

The liquid supplying part 15 is a member for supplying the solvent La to the porous body 11. The solvent La is supplied to the solid electrolyte film 13 from the porous body 11 through the through holes 14*c* of the masking plate 14. When a surface in contact with the masking plate 14 is a first surface 11*a* of the porous body 11, the liquid supplying part 15 is fixed to a second surface 11*b* of the porous body 11 in a state of being in contact with a second surface 11*b*. It is preferred that the liquid supplying part 15 is made from a material insoluble to the foregoing solvent La, and may be made from either metal or resin.

In the liquid supplying part 15, a supply passage 15*a* for supplying the solvent La, and a discharge passage 15*b* for discharge the solvent La are formed. One of openings of each of the supply passage 15*a* and the discharge passage 15*b* is formed at a position facing the surface 11*b* of the porous body 11 on the other side. Thus, the solvent La is flown suitably from the liquid supplying part 15 towards the through holes 14*c* of the masking plate 14, and the solvent La is supplied to the solid electrolyte film 13 effectively.

The solvent supplying device 21 includes an accommodation tank (not shown) that accommodates the solvent La, and a pressure pump (not shown) that feeds the solvent La under pressure from the accommodation tank. The solvent supplying device 21 is connected with the supply passage 15*a* of the liquid supplying part 15 so as to pressure-feed and supply the solvent La. The solvent supplying device 21 is connected with the discharge passage 15*b* so as to collect the solvent La from the discharge passage 15*b* of the liquid supplying part 15. In this way, the solvent supplying device 21 is able to circulate the solvent La inside the device.

Further, the pressure device 18 includes a hydraulic or pneumatic cylinder is connected with an upper part of the liquid supplying part 15. By providing the pressure device 18, it is possible to press the solid electrolyte film 13 uniformly against the surface wf of the substrate W during the surface treatment.

Figure 2A:
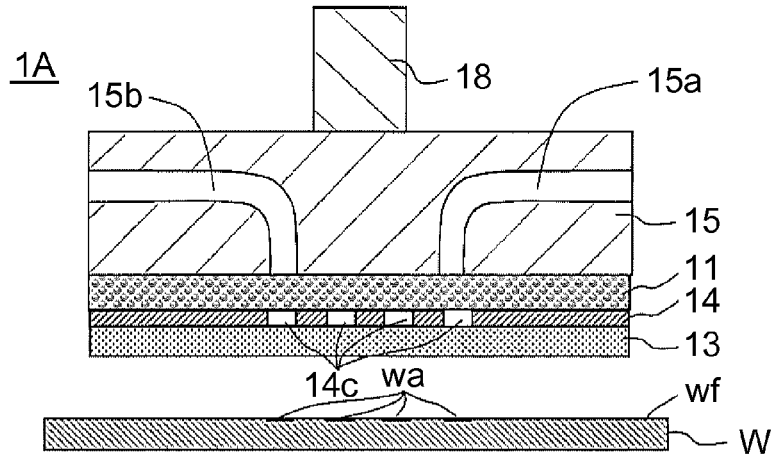
FIG. 2A is a schematic sectional view showing surface treatment for a substrate using the surface treatment device, and is a view showing a state before the surface treatment for the substrate.
Figure 2B:
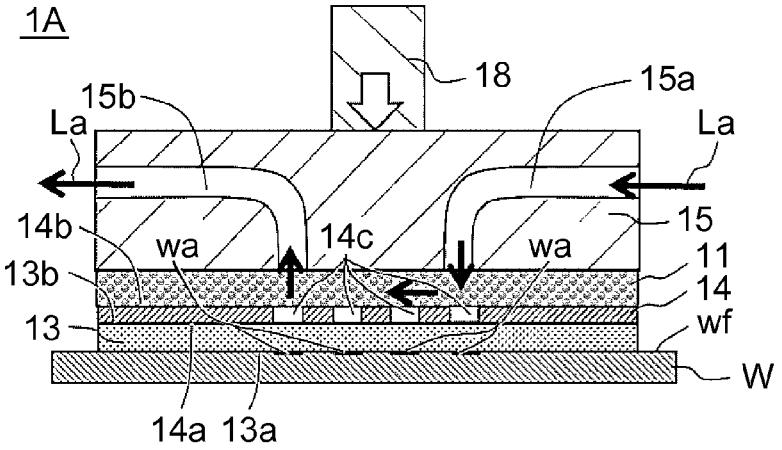
FIG. 2B is a schematic sectional view showing the surface treatment for the substrate using the surface treatment device shown in FIG. 1, and is a view showing a state during the surface treatment for the substrate.
Figure 2C:
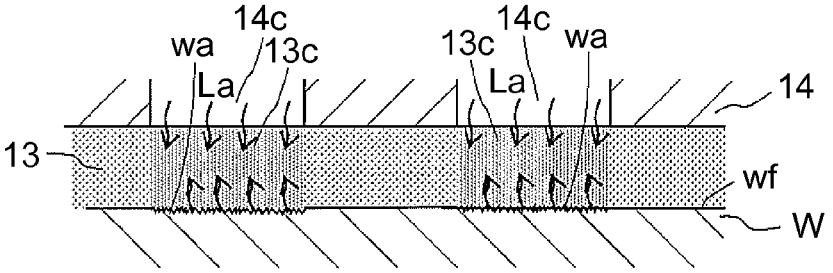
FIG. 2C is a partial enlarged view of the vicinity of the surface of the substrate shown in FIG. 2B.

Next, a surface treatment method using the surface treatment device 1A is explained. FIG. 2A to FIG. 2C are schematic sectional views for explaining the surface treatment for the substrate W by using the surface treatment device 1A shown in FIG. 1. FIG. 2A is a view showing a state before the surface treatment for the substrate W, FIG. 2B is a view showing a state during the surface treatment for the substrate W, and FIG. 2C is a partial enlarged view of the vicinity of the surface of the substrate W shown in FIG. 2B.

First of all, as shown in FIG. 2A, the substrate W is arranged at a position that faces the solid electrolyte film 13 of the surface treatment device 1A. In FIG. 2A, the surface regions wa to be roughened in the surface wf of the substrate W are shown by bold lines. However, in this stage, the surface regions wa have the same surface roughness as that of the rest of the surface.

Next, as shown in FIG. 2B, the pressure device 18 is operated, and the solid electrolyte film 13 is arranged on the substrate W so that the first surface 13*a* of the solid electrolyte film 13 comes into contact with the surface wf of the substrate W while pressurizing the surface wf. In the state of this arrangement, the masking plate 14 is arranged on the solid electrolyte film 13 so that the first surface 14*a* of the masking plate 14, in which the through holes 14*c* are formed, comes into contact with the second surface 13*b* of the solid electrolyte film 13.

In the state of this arrangement, the solvent supplying device 21 is operated to supply the solvent La to the supply passage 15*a* of the liquid supplying part 15. As shown in FIG. 2B, the solvent La flowing in the supply passage 15*a* flows towards the masking plate 14 through the porous body 11, and is supplied to the solid electrolyte film 13 from the second surface 14*b* of the masking plate 14 through the through holes 14*c*.

Thus, the solvent La penetrates portions 13*c* of the solid electrolyte film 13 in accordance with the shapes of the through holes 14*c*. The portions 13*c* of the solid electrolyte film 13, where the solvent La penetrates, are in contact with the surface wf of the substrate W. Therefore, in the surface wf of the substrate W, metal of the surface regions wa corresponding to the shapes of the through holes 14*c* of the masking plate 14 is dissolved by the solvent La due to an oxidation-reduction reaction. In this way, it is possible to roughen the surface regions wa of the substrate W easily (FIG. 2C).

For example, when the surface wf of the substrate W is made from a tin-based material, and an acid solution such as a sulfuric acid solution is used as the solvent La, $H^+$ in the solid electrolyte film 13 is conducted towards the surface regions wa of the substrate W. Then, a reaction of $Sn \rightarrow Sn^{2+}+2e^-$ happens in the surface regions wa of the substrate W, and a reaction of $2H^++2e^- \rightarrow H_2\uparrow$ also happens. Thus, it is possible to roughen the surface regions wa of the substrate W easily.

In this way, it is possible to roughen desired surface regions wa in the surface wf of the substrate W by using the solvent La, instead of masking the substrate W directly with a masking material or photoresist. Also, since the surface regions wa of the substrate W are roughened by the solvent La through the solid electrolyte film 13, it is possible to prevent too much solvent La from being adhered to the surface wf of the substrate W.

In particular, in this embodiment, since the solvent La from the liquid supplying part 15 is supplied to the plurality of through holes 14*c* of the masking plate 14 through the porous body 11, it is possible to supply the solvent La to the plurality of through holes 14*c* more uniformly. This makes it possible to roughen the surface regions wa of the substrate W more uniformly.

Figure 3:
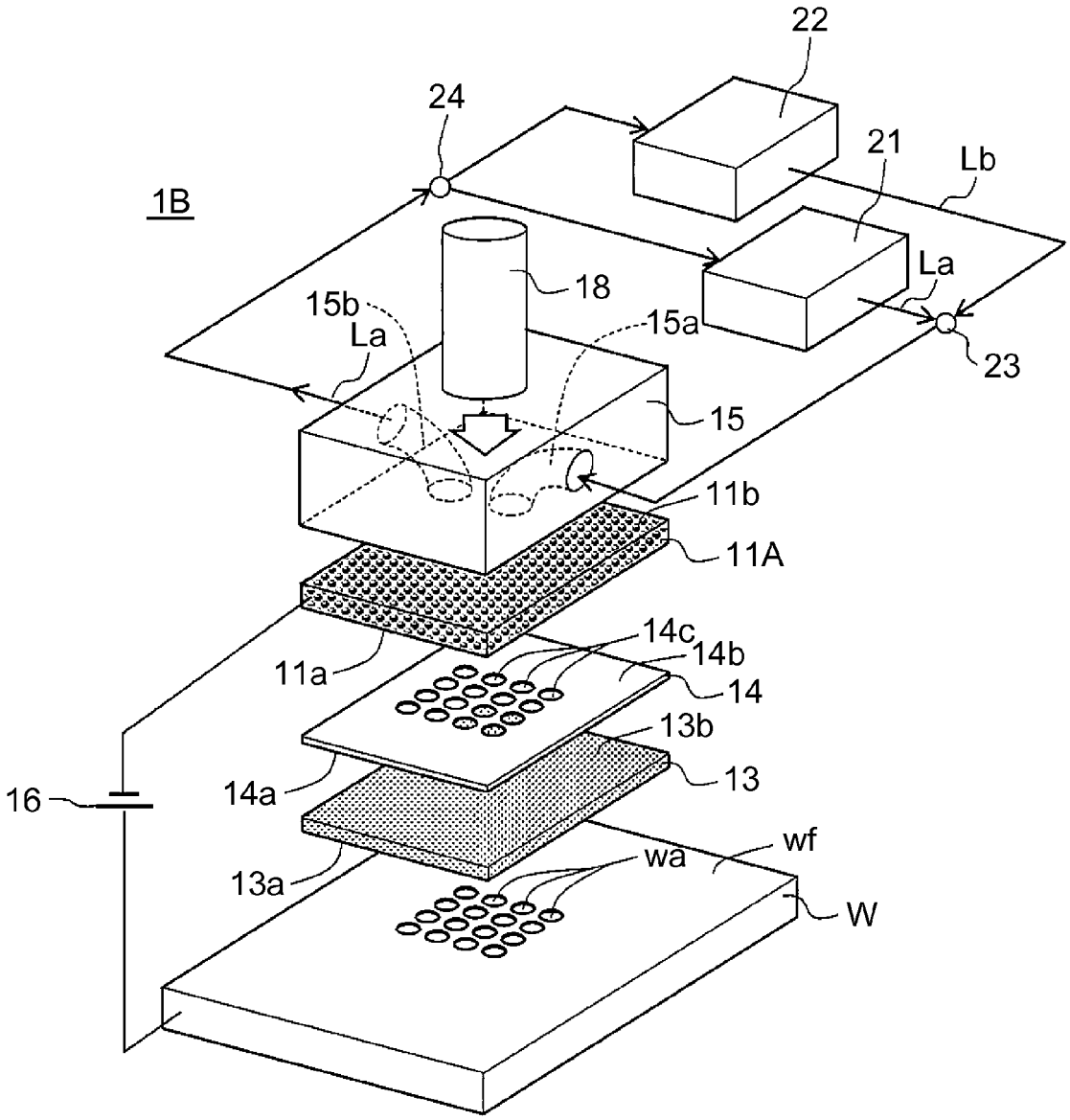
FIG. 3 is a schematic exploded perspective view of a surface treatment device according to the second embodiment of the invention.

Next, the second embodiment of the invention is explained. FIG. 3 is a schematic exploded perspective view of a surface treatment device 1B according to the second embodiment of the invention. The surface treatment device 1B according to this embodiment is different from the one in the first embodiment in that the porous body 11 is specified as a conductive member 11A having conductivity, that a power supply 16 for applying voltage to the conductive member 11A and the substrate W is provided, and that a metallic solution supplying device 22, and supply and discharge routes for a metallic solution Lb and so on are provided. The metallic solution supplying device 22 supplies the metallic solution Lb for film forming to a liquid supplying part 15. Therefore, members having the same structures as those in the surface treatment device 1A according to the first embodiment are denoted by the same reference numerals and their detailed explanation is omitted. In the second embodiment, a surface wf of a substrate W is limited to a surface made from metal.

As shown in FIG. 3, in this embodiment, the surface treatment device 1B includes the conductive member 11A arranged on the second surface 14*b* of a masking plate 14, and the power supply 16. The power supply 16 applies voltage between the substrate W and the conductive member 11A where the conductive member 11A serves as a negative electrode and the substrate W serves as a positive electrode. In this embodiment, the substrate W itself is a metallic substrate. However, when a surface layer of the aforementioned metal is formed on a surface of the non-conductive substrate such as a resin substrate and a silicon substrate, the surface layer of the substrate W is conductive with the power supply 16.

The conductive member 11A is made from a porous body. A solvent La and the later-described metallic solution Lb penetrate the porous body, and the porous body supplies the solvent La and the metallic solution Lb to a solid electrolyte film 13 through through holes 14*c* of the masking plate 14. A sealing material (not shown) is arranged in a peripheral edge of the conductive member 11A so that the solvent La and the metallic solution Lb do not leak out.

The above-mentioned porous body is not particularly limited as long as the porous body (1) has corrosion resistance to the solvent La and the metallic solution Lb, (2) has conductivity utilized as a positive electrode or a negative electrode, (3) is able to allow the solvent La and the metallic solution Lb penetrate, and (4) is able to press the solid electrolyte film 13 against a surface of the substrate W through the masking plate 14 by using a pressure device 18. It is preferred that the conductive member 11A is, for example, foamed metal made from a material with small oxygen overvoltage, such as platinum and iridium oxide, or foamed metal with high corrosion resistance, such as titanium, coated with platinum, iridium oxide or the like.

The power supply 16 is electrically connected with the conductive member 11A and the substrate W. The power supply 16 is structured so as to be able to apply voltage of about 1 to 20 V between the conductive member 11A and the substrate W in a state where the electrolyte film 13 is contact with a metallic surface wf of the substrate W. Further, the power supply 16 includes a switching circuit (not shown) that inverts polarity (switches polarity) of the power supply.

Figure 4A:
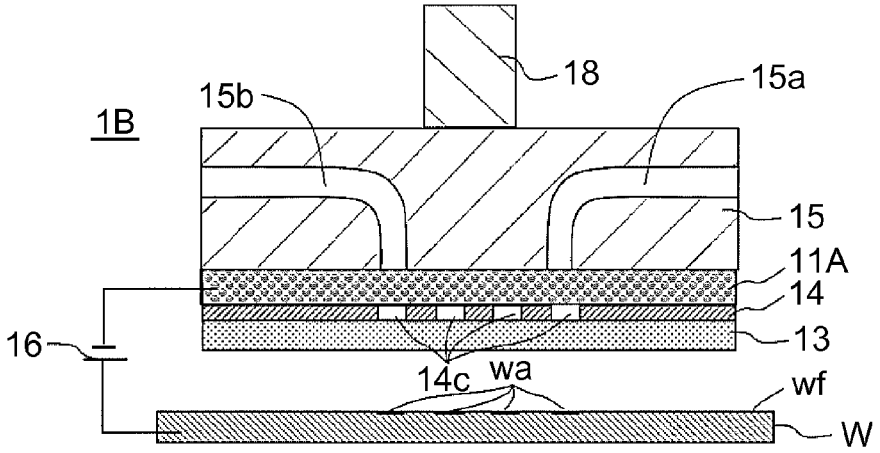
FIG. 4A is a schematic sectional view showing surface treatment for a substrate using the surface treatment device shown in FIG. 3, and is a view showing a state before the surface treatment for the substrate.
Figure 4B:
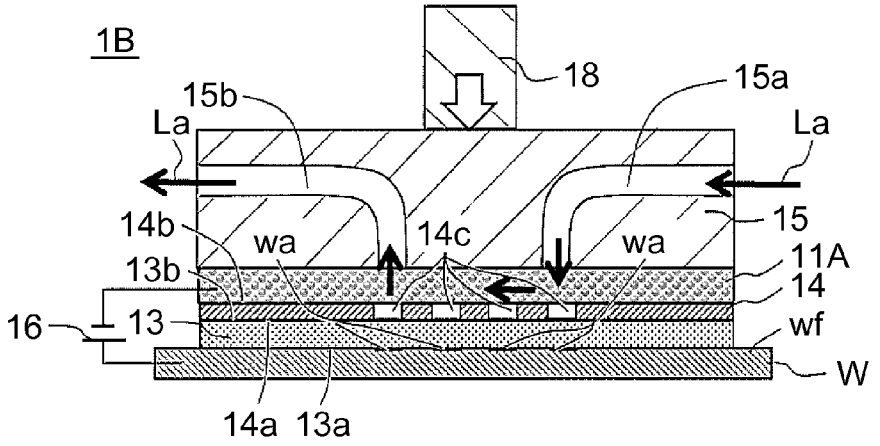
FIG. 4B is a schematic sectional view showing the surface treatment for the substrate using the surface treatment device shown in FIG. 3, and is a view showing a state during the surface treatment for the substrate.
Figure 4C:
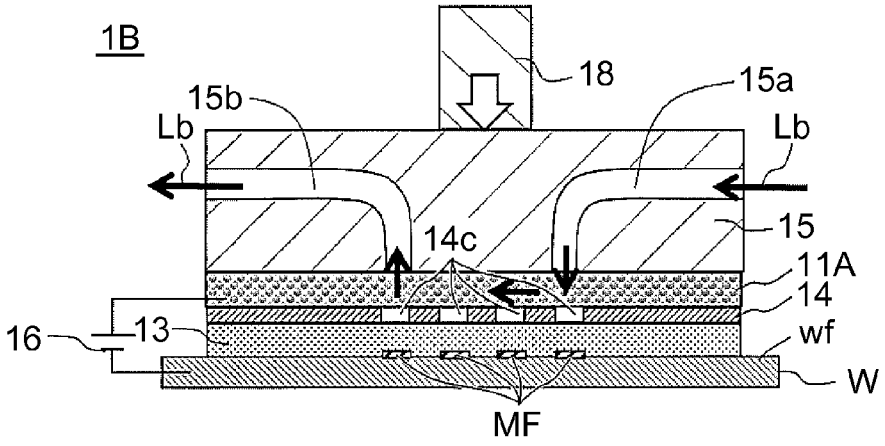
FIG. 4C is a view showing a film forming state after the surface treatment for the substrate shown in FIG. 4B.

Thus, as shown in FIG. 3, during the surface treatment, the power supply 16 is able to apply voltage between the conductive member 11A and the substrate W where the conductive member 11A serves as a negative electrode, and the substrate W serves as a positive electrode. Meanwhile, as shown in FIG. 4C, during later-described film forming, the switching circuit inverts polarity of the power supply, and the power supply 16 is able to apply voltage between the conductive member 11A and the substrate W where the conductive member 11A serves as a positive electrode, and the substrate W serves as a negative electrode.

The metallic solution supplying device 22 includes an accommodation tank (not shown) that accommodates the metallic solution Lb, and a pressure pump (not shown) that feeds the metallic solution Lb from the accommodation tank under pressure. The metallic solution supplying device 22 is connected with a supply passage 15*a* of the liquid supplying part 15 so as to pressure-feed and supply the metallic solution Lb. The metallic solution supplying device 22 is connected with a discharge passage 15*b* so as to collect the metallic solution Lb from the discharge passage 15*b* of the liquid supplying part 15. In this way, the metallic solution supplying device 22 is able to circulate the metallic solution Lb inside the device.

In this embodiment, the surface treatment device 1B is provided with a selector valve 23 in the supply passage 15*a* of the liquid supplying part 15. The selector valve 23 changes over between the solvent La from the above-mentioned solvent supplying device 21 and the metallic solution Lb from the metallic solution supplying device 22 so as to be able to supply the solvent La and the metallic solution Lb selectively. Further, a selector valve 24 is provided to change over between liquids discharged from the discharge passage 15*b* of the liquid supplying part 15 so that the liquids are selectively collected into the solvent supplying device 21 and the metallic solution supplying device 22.

The metallic solution Lb is a liquid containing metal ion of a metallic film formed, and may be, for example, an aqueous solution containing copper, nickel, or silver in a state of ion. For example, in a case where metal in the metallic solution is copper, the metallic solution Lb may be a solution containing copper nitrate, copper sulfate, copper pyrophosphate, or the like. When metal in the metallic solution is nickel, the metallic solution Lb may be a solution containing nickel nitrate, nickel sulfate, nickel pyrophosphate, or the like.

Further, as explained later with reference to FIG. 5C, the solid electrolyte film 13 may contain the above-mentioned metal in a state of ion when a metallic film MF is further formed on surface regions wa of the substrate W by using the metallic solution Lb. For example, a material for the solid electrolyte film is fluorine-based resin such as Nafion (registered trademark) manufactured by E. I. du Pont de Nemours and Company, hydrocarbon-based resin, polyamic acid resin, and a resin having ion exchange function such as SELEMION (CMV, CMD, CMF series) manufactured by Asahi Glass Co., Ltd.

Next, a surface treatment method and a film forming method using the surface treatment device 1B are explained. FIG. 4A to FIG. 4C are schematic sectional views for explaining surface treatment for a substrate by using the surface treatment device shown in FIG. 3. FIG. 4A is a view showing a state before the surface treatment for the substrate, FIG. 4B is a view showing a state during the surface treatment for the substrate, and FIG. 4C is a view showing a state of film formation after the surface treatment for the substrate.

First of all, as shown in FIG. 4A, a substrate W is arranged at a position facing the solid electrolyte film 13 of the surface treatment device 1B. At this time, the power supply 16 is electrically connected with the conductive member 11A and the substrate W. Therefore, the power supply 16 is able to apply voltage between the conductive member 11A and the substrate W where the conductive member 11A serves as a negative electrode, and the substrate W serves as a positive electrode. In FIG. 4A, surface regions wa to be roughened in the metallic surface wf of the substrate W are shown by bold lines. However, in this stage, the surface regions wa have the same surface roughness as that of the rest of the surface.

Next, as shown in FIG. 4B, the pressure device 18 is operated. Thus, the solid electrolyte film 13 is arranged on the substrate W in a state where a first surface 13*a* of the solid electrolyte film 13 is in contact with and applies pressure on the surface wf of the substrate W. In this state, the masking plate 14 is arranged on the solid electrolyte film 13 so that a first surface 14*a* is in contact with a second surface 13*b* of the solid electrolyte film 13. Further, the through holes 14*c* are formed in the masking plate 14.

In the state of the above-mentioned arrangement, the solvent supplying device 21 is operated to supply the solvent La to the supply passage 15*a* of the liquid supplying part 15. As shown in FIG. 4B, the solvent La flowing in the supply passage 15*a* flows towards the masking plate 14 through the porous conductive member 11A, and is supplied to the solid electrolyte film 13 through the plurality of through holes 14*c* from the second surface 14*b* of the masking plate 14.

In the state where the solvent La is supplied to the solid electrolyte film 13 through the plurality of through holes 14*c* from the second surface 14*b* of the masking plate 14, the power supply 16 applies voltage between the conductive member 11A serving as the negative electrode, and the substrate W serving as the positive electrode.

In the surface wf of the substrate W, metal in the surface regions wa corresponding to the shapes of the respective through holes 14*c* of the masking plate 14 is ionized by electrolysis. Thus, an oxidation-reduction reaction is promoted more than the first embodiment, and, in the surface wf of the substrate W, the surface regions wa corresponding to the shapes of the through holes 14*c* are partially roughened more swiftly and easily. In particular, it is possible to allow only the surface regions of the substrate W to have desired surface roughness by adjusting time of application, applied voltage, temperature of the substrate W and so on when voltage is applied between the substrate W and the conductive member 11A.

For example, when the surface wf of the substrate W is made from a tin-based material, and an acid solution such as a sulfuric acid solution is used as the solvent La, $H^+$ in the solid electrolyte film 13 is conducted towards the surface regions wa of the substrate W. Then, a reaction of $Sn \rightarrow Sn^{2+} + 2e^-$ happens in the surface regions wa of the substrate W, and a reaction of $2H^+ + 2e^- \rightarrow H_2\uparrow$ also happens. Thus, it is possible to roughen the surface regions wa of the substrate W easily.

In this embodiment, it is also possible to roughen desired surface regions wa in the surface wf of the substrate W by using the solvent La, instead of masking the substrate W directly with a masking material or photoresist. Also, since the surface regions wa of the substrate W are roughened by the solvent La through the solid electrolyte film 13, it is possible to prevent too much solvent La from adhering to the surface wf of the substrate W.

Next, after the surface treatment for the substrate W is finished, a metallic film MF is formed in the roughened surface regions wa. Specifically, the power supply 16 stops applying voltage temporarily while the pressure device 18 keeps applying pressure.

Next, the operation of the solvent supplying device 21 is stopped, the metallic solution supplying device 22 is operated, and the selector valves 23, 24 shown in FIG. 3 are switched. Thus, liquid to be supplied to the liquid supplying part 15 is changed from the solvent La to the metallic solution Lb. Then, the metallic solution Lb is circulated in the device, and is supplied to the solid electrolyte film 13 through the through holes 14*c*. In this way, metal ion is able to penetrate the solid electrolyte film 13.

As shown in FIG. 4C, in this state, the polarity of the power supply of the power supply 16 is inverted so that the conductive member 11A serves as a positive electrode and the substrate W serves as a negative electrode, and the power supply 16 applies voltage between the substrate W and the conductive member 11A. Thus, the metal ion of the metallic solution Lb that has penetrated the solid electrolyte film 13 is deposited on the roughened surface regions wa, thereby forming the metallic film MF in the surface regions wa.

As stated above, the solvent La is changed to the metallic solution Lb, and voltage is applied between the conductive member 11A and the substrate W after the polarity is inverted between the conductive member 11A and the substrate W (specifically, the polarity of the power supply of the power supply 16 is inverted). That is all it takes to form the metallic film MF on the surface regions wa of the substrate W easily. Because the metallic film MF is formed in the roughened surface regions of the substrate W, it is possible to partially form the metallic film MF with high adherence on the substrate W.

Further, in this embodiment, it is possible to use the pressure device 18 to press the conductive member 11A on the solid electrolyte film 13 uniformly against the surface wf of the substrate W through the masking plate 14. Therefore, it is possible to form the homogeneous metallic film MF with a more uniform thickness.

As stated above, during the surface treatment, the solvent La penetrates parts of the solid electrolyte film 13 in accordance with the shapes of the through holes 14*c* of the masking plate 14, and the metallic solution Lb penetrates when a film is formed. Therefore, the material for the masking plate 14 may be either a conductive or nonconductive material. When a nonconductive material such as a resin is used as a material for the masking plate 14, it is possible to clarify the roughening ranges by clarifying the surface regions wa and the rest of the regions. Thus, it is possible to form the metallic film MF with a conspicuous edge.

Figure 5A:
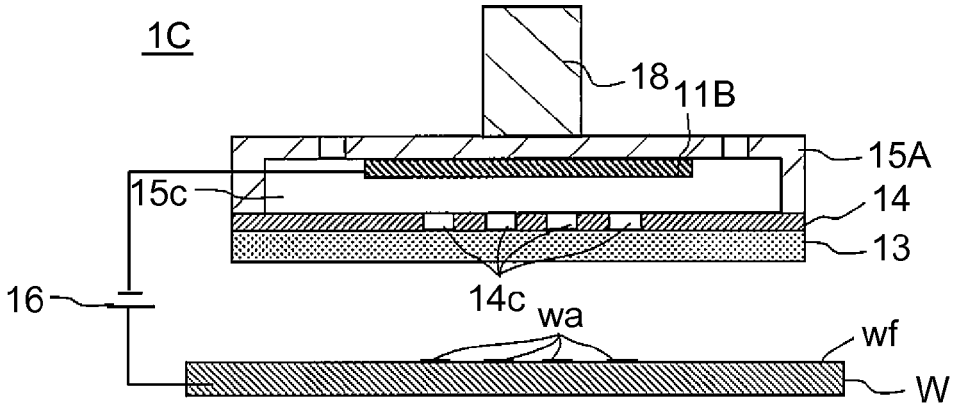
FIG. 5A is a schematic sectional view showing surface treatment for a substrate using a surface treatment device according to the third embodiment, and is a view showing a state before the surface treatment for the substrate.
Figure 5B:
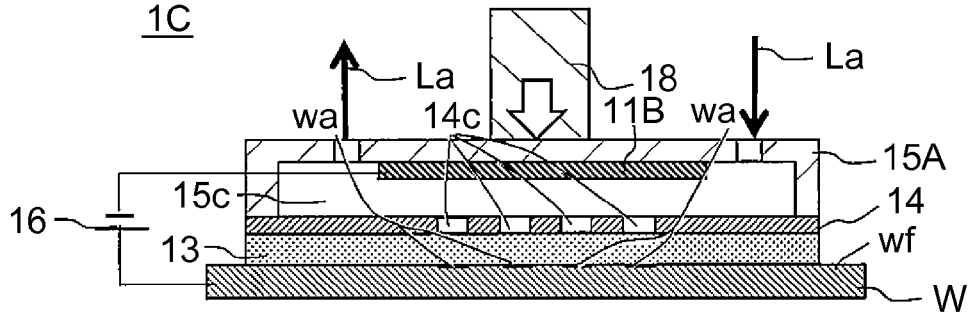
FIG. 5B is a schematic sectional view of the surface treatment for the substrate using the surface treatment device according to the third embodiment, and is a view showing a state during the surface treatment for the substrate.

Next, the third embodiment is explained. FIG. 5A to FIG. 5C are schematic sectional views for explaining surface treatment for a substrate using a surface treatment device according to the third embodiment. FIG. 5A is a view showing a state before the surface treatment for the substrate, FIG. 5B is a view showing a state during the surface treatment for the substrate, and FIG. 5C is a view showing a state of film formation after the surface treatment for the substrate shown in FIG. 5B.

A surface treatment device 1C according to this embodiment is different from the surface treatment device 1B according to the second embodiment in a structure of a liquid supplying part 15A, and position and structure of a conductive member 11B. Therefore, members having the same structures as those in the surface treatment device 1B according to the second embodiment are denoted by the same reference numerals, and their explanation is omitted.

As shown in FIG. 5A, in this embodiment, a liquid accommodating chamber 15*c* for accommodating a solvent La and a metallic solution Lb is formed in the liquid supplying part 15A, and the conductive member 11B is arranged to be separated from the second surface 14*b* of a masking plate 14. The conductive member 11B is a conductive nonporous body, and is made from a material that is insoluble in the solvent La and the metallic solution Lb.

During the surface treatment, as shown in FIG. 5B, a pressure device 18 presses a solid electrolyte film 13 against a surface wf of a substrate W similarly to the second embodiment, while supplying the solvent La to the liquid accommodating chamber 15*c* of the liquid supplying part 15A. Next, a power supply 16 applies voltage between the conductive member 11B serving as a negative electrode, and the substrate W serving as a positive electrode. Thus, in the surface wf of the substrate W, surface regions wa corresponding to shapes of through holes 14*c* are roughened swiftly and easily.

Figure 5C:
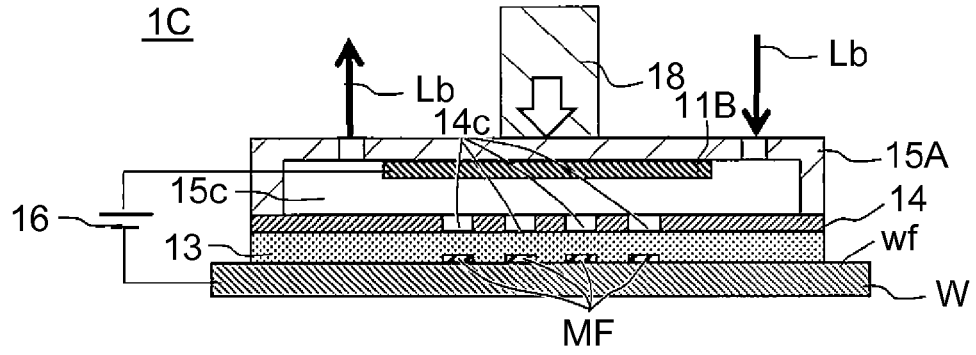
FIG. 5C is a view showing a film forming state after the surface treatment for the substrate shown in FIG. 5B.
Figure 6A:
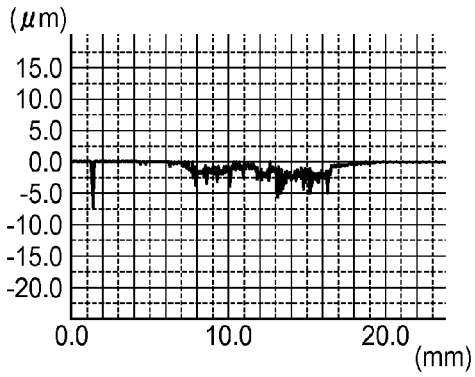
FIG. 6A is a showing measurement results of surface roughness of substrates according to examples 1.
Figure 6B:
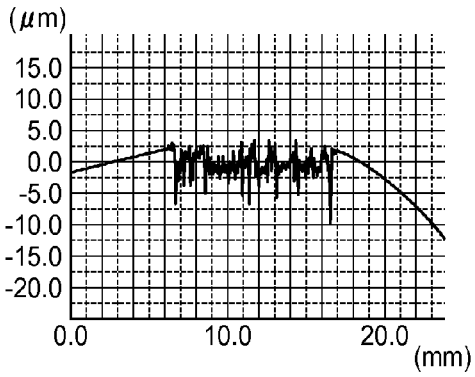
FIG. 6B is a view showing measurement results of surface roughness of substrates according to examples 2.
Figure 6C:
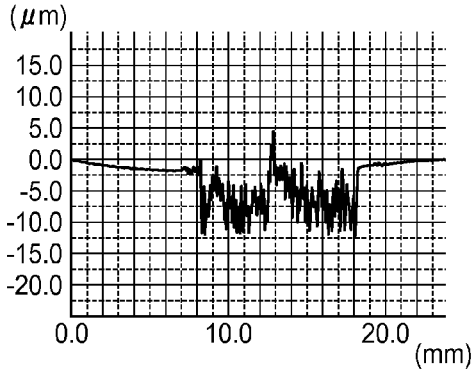
FIG. 6C is a view showing measurement results of surface roughness of substrates according to examples 3.
Figure 6D:
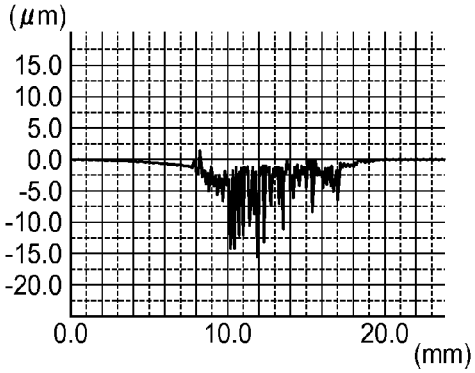
FIG. 6D is a view showing measurement results of surface roughness of substrates according to examples 4.

Further, similarly to the second embodiment, when a film is formed, liquid to be supplied to the liquid supplying part 15A is changed from the solvent La to the metallic solution Lb as shown in FIG. 5C. Next, the polarity of the power supply of the power supply 16 is inverted so that the conductive member 11B serves as a positive electrode, and the substrate W serves as a negative electrode, and the power supply 16 applies voltage between the substrate W and the conductive member 11A. Thus, metal ion of the metallic solution Lb that has penetrated the solid electrolyte film 13 is deposited on the roughened surface regions wa, thereby forming a metallic film MF in the surface regions wa.

The invention is explained below based on examples. First of all, example 1 is explained. The aforementioned surface treatment device according to the second embodiment was used to partially roughen a surface of a substrate (50 mm×50 mm×thickness of 1 mm) made from oxygen-free copper. As a conductive member, foamed titanium (a porous body of 10 mm×10 mm×1 mm, which is made from foamed titanium having porosity of 85 volume % (manufactured by Mitsubishi Materials Corporation)) was used. A 0.5 mm-thick masking plate with a through hole of 10 mm×10 mm was used. For a solid electrolyte film, Nafion NR211 manufactured by E. I. du Pont de Nemours and Company was used, and 30 percent sulfuric acid aqueous solution was used as a solution. In the surface of the substrate, a surface corresponding to the shape of the through hole (10 mm×10 mm) was regarded as a surface region to be roughened.

When a substrate is roughened, temperature of the substrate was set to 25° C., and a power supply applied voltage between the substrate serving as a positive electrode, and a conductive member serving as a negative electrode under conditions of applied voltage of 3.0V and time of application of one minute, while a pressure device was pressing a solid electrolyte film against the surface of the substrate at 1.0 MPa.

Next, example 2 is explained. Similarly to example 1, a surface of a substrate was partially roughened. A difference from example 1 is that time of application of voltage was five minutes.

Example 3 is explained. Similarly to example 1, a surface of a substrate was partially roughened. A difference from example 1 is that time of application of voltage was ten minutes.

Example 4 is explained. Similarly to example 1, a surface of a substrate is partially roughened. A difference from example 1 is that substrate temperature for carrying out surface treatment was 60° C.

In the surfaces of the substrates according to examples 1 to 4, surface roughness of the roughened surfaces was measured. The results are shown in Table 1 and FIG. 6A to FIG. 6D. FIG. 6A to FIG. 6D are views showing the results of measurements of surface roughness of the substrates according to examples 1 to 4, and, specifically, views showing surface profiles of the surfaces.

TABLE 1

| | Time of application (minutes) | Substrate temperature (° C.) | Surface roughness Ra (μm) | Surface roughness Rz (μm) |
|---|---|---|---|---|
| Example 1 | 1 | 25 | 0.16 | 1.22 |
| Example 2 | 5 | 25 | 0.31 | 2.00 |
| Example 3 | 10 | 25 | 0.67 | 3.68 |
| Example 4 | 1 | 60 | 0.57 | 3.84 |

As shown in FIG. 6A to FIG. 6D, in the surfaces of the substrates according to examples 1 to 4, the surface regions corresponding to the through holes of the masking plates were roughened. Further, as shown in Table 1, it was found that it is possible to control surface roughness in accordance with time of voltage application and temperature of the substrates.

Although embodiments of the invention are described in detail above, the invention is not limited to the foregoing embodiments, and various design changes may be made without departing from the spirit of the invention described in the scope of claims.

What is claimed is:

1. A surface treatment method, comprising:

roughening a surface region of a substrate corresponding to a through hole provided in a masking plate by supplying a solvent to a solid electrolyte film from a second surface of the masking plate through the through hole, in a state where a first surface of the solid electrolyte film is arranged directly on the surface of the substrate, and a first surface of the masking plate is arranged directly on a second surface of the solid electrolyte film, wherein the supplied solvent penetrates the solid electrolyte film, and dissolves the surface of the substrate.

2. The surface treatment method according to claim 1, wherein the surface of the substrate is made from metal, and the roughening includes applying voltage between the substrate serving as a positive electrode and a conductive member serving as a negative electrode in a state where the conductive member is provided on the second surface of the masking plate.

3. The surface treatment method according to claim 2, wherein the solvent is supplied from a liquid accommodating chamber of a liquid supplying part, and the conductive member is arranged on the second surface of the masking plate through the liquid accommodating chamber.

4. A method for forming a metallic film, comprising:

roughening a surface region of the substrate by the surface treatment method according to claim 2;

after the roughening, allowing metal ion to penetrate the solid electrolyte film by supplying a metallic solution containing the metal ion of the metallic film to the solid electrolyte film through the through hole; and forming a metallic film on the surface region by depositing the metal ion of the metallic solution on the roughened surface region by applying voltage between the substrate serving as a negative electrode and the conductive member serving as a positive electrode.

5. The surface treatment method according to claim 1, wherein the masking plate is made of a nonconductive material.

* * * * *